United States Patent [19]

Omori et al.

[11] Patent Number: 4,769,170

[45] Date of Patent: Sep. 6, 1988

[54] WASHING SOLUTION FOR PRINTING INK

[75] Inventors: Hiroyuki Omori, Tokyo; Teruhiko Ishii; Katsuhiko Yamada, both of Mie, all of Japan

[73] Assignee: Mitsubishi Yuka Fine Chemicals Co., Ltd., Yokkaichi, Japan

[21] Appl. No.: 863,188

[22] Filed: May 14, 1986

[30] Foreign Application Priority Data

May 22, 1985 [JP] Japan ..... 60-109598
Oct. 21, 1985 [JP] Japan ..... 60-234876

[51] Int. Cl.[4] ..... C11D 3/48; C11D 9/50; C11D 9/60

[52] U.S. Cl. ..... 252/107; 252/106; 252/117; 252/174.15; 252/174.21; 252/358; 252/523; 252/529; 252/541; 252/548

[58] Field of Search ..... 252/548, 153, 529, 523, 252/174.15, 541, 117, 174.21, 106, 107, 358, 108

[56] References Cited

U.S. PATENT DOCUMENTS

| | | | |
|---|---|---|---|
| 3,814,693 | 6/1974 | Kudler | 252/111 |
| 3,886,099 | 5/1975 | Hall | 252/548 |
| 3,951,833 | 4/1976 | Juda et al. | 252/51 |
| 4,024,072 | 5/1977 | Shane et al. | 252/358 |
| 4,159,253 | 6/1979 | Grier et al. | 252/51.5 |
| 4,285,840 | 8/1981 | Fricker | 252/548 |
| 4,522,740 | 6/1985 | Schmid et al. | 252/156 |
| 4,599,189 | 7/1986 | Warmann et al. | 252/358 |

*Primary Examiner*—Paul Lieberman
*Assistant Examiner*—Linda D. Skaling
*Attorney, Agent, or Firm*—Oblon, Fisher, Spivak, McClelland & Maier

[57] ABSTRACT

A washing solution for flexographic ink is disclosed, comprising the components (A) to (E):

Component (A):

0.05 to 35 wt % of an amine selected from water-soluble aliphatic primary or secondary amines having 2 to 3 carbon atoms, ammonia and morpholine, or an alkaline substance selected from hydroxides, carbonates, borates, silicates, phosphates and alkaline lower fatty acid salts of alkali metal;

Component (B):

0.001 to 1.0 wt % of a defoaming agent;

Component (C):

0 to 75 wt % of an aliphatic polyhydric alcohol having a molecular weight of 500 or less;

Component (D):

0 to 75 wt % of a water-soluble aliphatic monohydric alcohol having 1 to 4 carbon atoms; and Component (E):

25 to 99.9 wt % of water.

1 Claim, No Drawings

WASHING SOLUTION FOR PRINTING INK

FIELD OF THE INVENTION

The present invention relates to an aqueous washing solution for printing ink, and more particularly to an aqueous washing solution which is used to wash flexographic ink adhered to a printing roll, an ink-supplying and circulating pipe, a flexographic plate and so forth of a flexographic press when exchanging the lot.

BACKGROUND OF THE INVENTION

A flexographic press using a water-soluble ink is widely used as a high-speed printing machine of, for example, corrugated cardboard. A flexographic ink dries quickly because the ink is aqueous, and therefore permits high speed printing. In this flexographic press, when the lot is exchanged or the color of ink is changed, it is necessary to completely remove ink adhered to rolls such as an ink roll, a doctor roll and a printing roll, and a cover, and ink remaining in an ink circulating system into which the ink is supplied and from which excess of ink is recovered, by washing with water as disclosed, for example, in Japanese patent application (OPI) Nos. 118808/75 and 86757/81 (The term "OPI" as used herein refers to a "published unexamined Japanese patent application").

Furthermore it is necessary to completely remove ink adhered to a printing plate with hands or a washing machine after printing, to store the printing plate.

A washing solution prepared by emulsifying or dispersing an aromatic hydrocarbon solvent such as kerosene and xylene in an aqueous solution of sodium silicate using a surface active agent such as sorbitan monooleate or an organic dibasic acid alkyl ester sulfonate is known as a washing solution for such flexographic ink as disclosed, for example, in Japanese patent application (OPI) No. 2509/78.

A flexographic ink is mainly comprised of a maleic acid resin binder such as an amine salt of a styrene-maleic acid copolymer or an amine salt of a maleic acid-grafted resin, a pigment, ethyl alcohol and water.

When the flexographic ink is dried after printing, low molecular weight amines such as ammonia and diethanolamine are released from the carboxyl group of the styrene-maleic acid copolymer and scattered in air, and as a result, the water-soluble styrene-maleic acid copolymer becomes water-insoluble.

After completion of the printing operation using the flexographic ink, a large amount of the flexographic ink remains on a printing machine or a printing plate. Part of the flexographic ink dries and remains by adhering to an ink flow path, the plate and so forth of the printing machine. At this stage, however, the amine does not remain in the terminal of the residue in a sufficient amount to make it soluble in water. Therefore, as a matter of course, the remaining ink cannot be removed by washing with water which is a solvent for the ink. The reason for this is that the amine is released and the free carboxylic acid is exposed at the terminal.

The washing solution of Japanese patent application (OPI) No. 2509/78 contains an emulsifying agent therein. Therefore, when the washing solution is used in heavy washing, such as washing of the machine, the solution foams and overflows, thereby causing problems such as breakdown of the electric system and corrosion of the walls, and seriously damaging the machine. Even in the case of using washing solutions other than the washing solution of Japanese patent application (OPI) No. 2509/78 which contains an emulsifying agent, inks contain foamable surface active agents to improve the solution stability thereof and foaming of the solution after washing cannot be prevented.

SUMMARY OF THE INVENTION

Accordingly, an object of the present invention is to provide an aqueous washing solution in which water-soluble lower amines such as ammonia, morpholine and monoethanolamine or alkaline substances such as alkali hydroxides or alkali metal salts are used to neutralize a binder resin containing a carboxyl group, and which contains a defoaming agent such as silicone oil or amide, to prevent foaming of a washing solution as encountered in circulation of the washing solution in e.g., pipes in a washing machine for plates of a flexographic press, transportation of the plates by rolling, and brushing of the plates.

The washing solution for flexographic ink according to the present invention comprises the following components (A) to (E):

Component (A)

0.05 to 35 wt % of an amine selected from water-soluble aliphatic primary or secondary amines having 2 to 3 carbon atoms, ammonia and morpholine, or an alkaline substance selected from hydroxides, carbonates, borates, silicates, phosphates and alkaline lower aliphatic acid salts of alkali metal.

Component (B)

0.001 to 1.0 wt % of a defoaming agent.

Component (C)

0 to 75 wt % of a water-soluble aliphatic polyhydric alcohol having a molecular weight of 500 or less.

Component (D)

0 to 75 wt % of a water-soluble aliphatic monohydric alcohol having 1 to 4 carbon atoms.

Component (E)

25 to 99.9 wt % of water.

DETAILED DESCRIPTION OF THE INVENTION

Water-soluble amines used as the component (A) are used to form water-soluble salts by reacting the same with a hydrophobic maleic acid resin. Examples of the water-soluble amine include water-soluble aliphatic mono- or diamines such as monoethanolamine, diethanolamine, monoethylamine, diethylamine, monoisopropylamine, n-butylamine or ethyleneimine; morpholine; and ammonia.

Tertiary amines such as triethanolamine, however, are not sufficiently satisfactory to convert solidified ink into a water-soluble salt.

Examples of alkaline substances used as the component (A) include alkali metal hydroxides such as sodium hydroxyde, potassium hydroxide and lithium hydroxide; alkali metal carbonates such as sodium carbonates such as sodium carbonate and potassium carbonate; alkali metal borates such as sodium borate and borax; alkali metal phosphates such as sodium tripolyphospate and alkaline lower aliphatic acid salts such as sodium acetate.

These compounds as the component (A) can be used alone or in combinations thereof.

These amines and alkaline substances are used in an amount of 0.05 to 35 wt %, preferably 0.5 to 5 wt %, based on the weight of the washing solution. If the amount of the amine or alkaline substance in the washing solution is less than 0.05 wt %, it is difficult to make the solidified ink water-soluble sufficiently. On the other hand, even if the amine, or alkaline substance is added in an amount of more than 35 wt %, further improvement in water solubility cannot be expected and the addition of such an excess amount of the amine or alkaline substance is disadvantageous from an economic standpoint.

The defoaming agent which can be used is a defoaming agent which can be dispersed in water in the form of particles having a particle size of 3 microns or less, preferably 0.005 to 1 micron, by itself or using a surface active agent or a protective colloid, or is soluble in water. For example, the following materials can be used.

A polyether-polyol of a metallic soup selected from aluminum stearate and calcium oleate;

Mineral oil such as kerosene, fluid paraffin and sulfated sperm oil, to which surface active agents or metallic soaps are usually compounded to disperse the mineral oil in water;

Silicone oils such as silicone paste, fluorosilicone oil and a compound of the formula

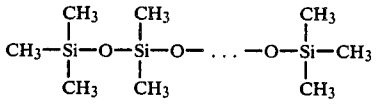

an inorganic filler such as calcium carbonate or silica, or a surface active agent is generally added as a dispersing agent to decrease a particle size of the defoaming agent;

Aliphatic acid esters such as diethylene glycol laurate, glycerine monolicinolate, alkenylsuccinic acid derivatives, polyoxyethylene monolaurate, polyoxyethylene sorbitol monolaurate, and natural wax;

Aliphatic acids such as oleic acid and stearic acid;

Phosphoric acid esters such as tributyl phosphate and sodium octyl phosphate;

Amides such as polyoxyalkyleneamide, acrylatepolyamine, ethylenebisstearylamide, amides obtained by reacting alkylamines and aliphatic acids, and butanedicetylamide; and Alcohols having 6 or more carbon atoms, such as octyl alcohol, hexadecyl alcohol, polyoxyalkylene glycol, Pluronic ® alcohols, i.e, polyether-polyols of block copolymers of propylene oxide and ethylene oxide polyetherurethane modified products, and glycidyl ether derivatives.

These compounds can be used alone or in combinations thereof.

The amount of the defoaming agent used is 0.001 to 1.0 wt % based on the weight of the washing solution. If the amount thereof is less than 0.001 wt %, the defoaming effect cannot be obtained. On the other hand, if the defoaming agent is added in an amount of more than 1.0 wt %, further improvement in the defoaming effect cannot be expected, and the addition of more than 1.0 wt % of the defoaming agent is disadvantageous from an economic standpoint.

A water-soluble polyhydric alcohol acts as a defoaming agent. Examples thereof are water-soluble aliphatic polyhydric alcohols having a molecular weight of 500 or less, such as ethylene glycol, diethylene glycol, propanediol, butanediol, triethylene glycol, tetraethylene glycol, pentanediol, hexanediol, glycerine, pentaerythritol, trimethylolpropane, polyethylene glcol, and polypropylene glycol.

The amount of the polyhydric alcohol used is 0 to 75 wt %, preferably 3 to 25 wt %, based on the weight of the washing solution.

A water-soluble monohydric alcohol is added if necesary. The addition of the monohydric alcohol facilitates the removal of the resin from the plate and shows the effect of breaking bubbles. Examples of the monohydric alcohols are water-soluble alcohols such as methanol, ethanol, propanol and butanol. The amount of the monohydric alcohol used is 75 wt % or less based on the weight of the washing solution.

Water is used as an inexpensive solvent in an amount of 20 to 99.9 wt %, preferably 50 to 96 wt %, based on the weight of the washing solution. If the amount of water used is more than 99.9 wt %, the resulting washing solution is not satisfactory in the washing power and defoaming effect.

In addition to the above components, an antiseptic agent may be added.

Examples of the antiseptic agent which can be used include thiazole compounds such as methylisothiazolone and benzoisothiazolone, and triazine compounds such as hexahydro-1,3,5-tris(2-hydroxyethyl)-S-triazine and hexahydro-1,3,5-triethyl-S-triazine. The amount of the antiseptic agent used is 1 to 1,000 ppm based on the weight of the washing solution.

A washing apparatus for a roll, a plate and so forth of a flexographic press is described in Japanese patent application (OPI) Nos. 118808/75 and 86757/81. Solidified flexographic ink is washed by blowing the washing solution of the present invention or impregnating the ink with the washing solution of the present invention.

The present invention is described in greater detail by reference to the following examples, and comparative examples.

EXAMPLES 1 TO 8, AND COMPARATIVE EXAMPLES 1 TO 7

Washing solution having the compositions shown in Table 1 below were prepared.

8 ml of each washing solution was placed in a 10 milliliter glass bottle, and then 0.08 g of divided solid flexographic ink containing an aqueous maleic acid resin (produced by Dainippon Ink Kagaku Kogyo Co., Ltd.) as a binder was introduced in the bottle. The solubility of the solidified ink was evaluated in the following manners.

◎: Dissolved in one minute.

○: Dissolved in 1 minute to 0.5 hour.

Δ: Dissolved in 0.5 to 5 hours.

×: Impossible to dissolve even after 5 hours.

The bottle was covered with a lid, shaked strongly 20 times, and then allowed to stand. The defoaming effect was evaluated as follows:

◎: Foams disappeared in 10 seconds.

○: Foams disappeared in 1 minute.

Δ: Foams disappeared in 1 to 5 minutes

×: Foams dis not disappear even after 5 minutes.

The results obtained are shown in Table 1 below.

TABLE 1

| Composition of Washing Solution (wt %) | Examples 1 | 2 | 3 | 4 | 5 | 6 | 7 | 8 | Comparative Examples 1 | 2 | 3 | 4 | 5 | 6 | 7 |
|---|---|---|---|---|---|---|---|---|---|---|---|---|---|---|---|
| Monoethanolamine | 1 | 0.1 | 30 | | | 2 | | 15 | | | | 1 | 1 | 15 | 5 |
| Diethanolamine | | | | | 2 | | | | | | | | | | |
| Triethanolamine | | | | | | | | | 10 | | | | | | |
| Morpholine | | | | 10 | | | | | | | | | | | |
| Ammonia | | | | | | | 2 | | | | | | | | |
| Methanol | 5 | 70 | | 5 | 5 | 20 | 5 | | 5 | 5 | | 5 | 5 | 50 | |
| Ethanol | | | 5 | | | | | | | | | | | | |
| Epan 410* | 0.1 | | | | | | | | | | | | | | |
| Pluronic ® type, i.e., polyether-polyols of block copolymers of propylene oxide and ethylene oxide | | | | | | | | | | | | | | | |
| Nopco NXZ** (Metallic soap type) | 0.01 | | | | | | | | | | | | | | |
| Nopco 8034-L** (Silicone-type) | | | 0.001 | 0.005 | | | | | | | | | | | |
| Nopco 267-A** (Amide type) | | | | | 0.1 | 0.05 | 0.01 | 0.01 | | | | | | | |
| Span 80 (Sorbitan monooleate) | | | | | | | | | | | 0.01 | | | | |
| Water | 94 | 30 | 65 | 85 | 93 | 78 | 93 | 85 | 85 | 95 | 100 | 94 | 94 | 35 | 95 |
| Evaluation | | | | | | | | | | | | | | | |
| Ink-Dissolving Properties | ◎ | ◎ | ◎ | ◎ | ◎ | ◎ | ◎ | ◎ | X | X | X | ◎ | ◎ | ◎ | Δ |
| Defoaming Properties | ◎ | ◎ | ◎ | ◎ | ◎ | ◎ | ◎ | ◎ | ○ | X | ○ | Δ | Δ | X | ○ |

*Tradename, a product of Daiichi Kogyo Seiyaku Co.
**Tradenames, products of San Nopco Co.

EXAMPLES 9 TO 18, AND COMPARATIVE EXAMPLES 8 TO 15

Washing solutions having the compositions shown in Table 2 were prepared and evaluated in the same manner as in Example 1.

The results obtained are shown in Table 2 below.

EXAMPLES 19 TO 27

Washing solutions comprising 5 parts by weight of monoethanolamine, 10 parts by weight of methanol, 0.01 part by weight of the defoaming agents shown in Table 3 below, and 85 parts of water were prepared and evaluated in the same manner as in Example 1.

The results obtained are shown in Table 3 below.

TABLE 2

| Composition of Washing Solution (wt %) | Examples 9 | 10 | 11 | 12 | 13 | 14 | 15 | 16 | 17 | Comparative Examples 8 | 9 | 10 | 11 | 12 | 13 | 14 |
|---|---|---|---|---|---|---|---|---|---|---|---|---|---|---|---|---|
| Alkaline Substance: | | | | | | | | | | | | | | | | |
| Sodium hydroxide | 1 | | | 0.02 | | | | 1 | 1 | | | 1 | | | | |
| Potassium hydroxide | | 0.1 | | | | | | | | | | | | | 1 | |
| Potassium carbonate | | | 40 | | | | | | | | | | | | | 40 |
| Boric acid | | | | 0.2 | | | | | | | | | 1 | | | |
| Sodium metasilicate | | | | | 5 | | 0.1 | | | | 5 | | | | | |
| Sodium tripolyphosphate | | | | | | 10 | | | | | | | | 10 | | |
| Defoaming Agent: | | | | | | | | | | | | | | | | |
| Epan 410* | | 0.1 | | | | | | | 0.1 | | | | | | | |
| Pluronic ® type, i.e., polyether-polyols of block copolymers of propylene oxide and ethylene oxide | | | | | | | | | | | | | | | | |
| Nopco NXZ** (Metallic soap type) | | | | | 0.01 | | | | | | | | | | | |
| Nopco 8034-L** (Silicone type) | 0.01 | | 0.005 | | | | 0.005 | | | | | | | | | |
| Nopco 267-A** | | | | 0.01 | | 0.05 | | 0.05 | | | | | | | | |
| Monothanol amine | | | | | | | 1. | | | | | | | | | |
| Ethyl alcohol | | | | | | | | 5 | 38.9 | | | | | | | |
| Water | 98.99 | 99.8 | 59.995 | 99.79 | 94.99 | 89.95 | 98.85 | 93.95 | 60 | 100 | 95 | 100 | 99 | 90 | 99 | 60 |
| Evaluation | | | | | | | | | | | | | | | | |
| Ink-Dissolving Properties | ◎ | ◎ | ◎ | ◎ | ◎ | ◎ | ◎ | ◎ | ◎ | X | ◎ | ◎ | Δ | ◎ | ◎ | ◎ |
| Deforming Properties | ◎ | ◎ | ◎ | ◎ | ◎ | ◎ | ◎ | ◎ | ◎ | ○ | Δ | X | X | X | X | X |

TABLE 3

| Example No. | Tradename | Main Component | Manufacturer | Ink-Dissolving Properties | Defoaming Properties |
|---|---|---|---|---|---|
| 19 | BYK-073 | Metallic soap Mineral oil | BYK-Chemie Japan KK | ◎ | ◎ |
| 20 | BYK-080 | Emulsifying agent Specific modified | BYK-Chemie Japan KK | ◎ | ◎ |

TABLE 3-continued

| Example No. | Tradename | Main Component | Manufacturer | Ink-Dissolving Properties | Defoaming Properties |
|---|---|---|---|---|---|
| | | silicone | | | |
| 21 | Surfinol | Acetylene glycol | Air Products & Chemicals | ◎ | ◎ |
| 22 | Jiollin | Polyether urethane | Mitsubishi Petrochemical Co. | ◎ | ◎ |
| 23 | UDF-555 | Glycidyl ether adduct | Itsuposha-yushi Co. | ◎ | ◎ |
| 24 | | Tributyl phosphate | — | ◎ | ◎ |
| 25 | | Ethylenebis-(stearyl-amide) | — | ◎ | ◎ |
| 26 | KM-73A | Silicone emulsion | Shin-etsu Silicone Co. | ◎ | ◎ |
| 27 | KS-66 | Silicone compound | Shin-etsu Silicone Co. | ◎ | ◎ |

What is claimed is:

1. A washing solution for flexographic ink, consisting essentially of:

(a) 0.05–35 weight % of an amine selected from the group consisting of water-soluble aliplatic primary or secondary amines having 2 to 3 carbon atoms, ammonia, and morpholine, or an alkaline substance selected from the group consisting of hydroxides, carbonates, borates, silicates, phosphates and alkaline lower fatty acid salts of an alkali metal;

(b) 0.001–1.0 weight % of a defoaming agent;

(c) 25–99% by weight of water, and wherein said defoaming agent is selected from the group consisting of a polyether-polyol of a metallic soap of aluminum stearate or calcium oleate; silicone oil, polyoxyalkylene-amide, an organic phosphoric acid ester, an aliphatic acid ester, and a block copolymer of propylene oxide and ethylene oxide; and (d) a thiazole compound selected from the group consisting of methylisothiazolone and benzoisothiazolone and a triazine compound selected from the group consisting of hexahydro-1,3,5-tris (alpha-hydroxyethyl)-S-triazine and hexahydro-1,3,5-triethyl-S-triazine in the amount of about 1 to 1000 ppm based upon the weight of the washing solution.

* * * * *